US010670381B1

(12) United States Patent
Anderson et al.

(10) Patent No.: US 10,670,381 B1
(45) Date of Patent: Jun. 2, 2020

(54) ELECTRONIC THERMALLY-INITIATED VENTING SYSTEM (ETIVS) FOR ROCKET MOTORS

(71) Applicant: THE GOVERNMENT OF THE UNITED STATES OF AMERICA AS REPRESENTED BY THE SECRETARY OF THE NAVY, Arlington, VA (US)

(72) Inventors: Paul E. Anderson, Ridgecrest, CA (US); Michael D. Haddon, Ridgecrest, CA (US)

(73) Assignee: The United States of America, as Represented by the Secretary of the Navy, Washington, DC (US)

( * ) Notice: Subject to any disclaimer, the term of this patent is extended or adjusted under 35 U.S.C. 154(b) by 1819 days.

(21) Appl. No.: 13/999,547

(22) Filed: Apr. 10, 2014

Related U.S. Application Data

(60) Provisional application No. 61/854,266, filed on Sep. 17, 2013.

(51) Int. Cl.
*F42B 39/14* (2006.01)
*F42C 11/00* (2006.01)

(52) U.S. Cl.
CPC ..... *F42B 39/14* (2013.01); *F42C 11/008* (2013.01)

(58) Field of Classification Search
CPC .... F42B 39/14; F42C 9/10; F42C 9/12; F42C 9/16; F42C 11/008; F42C 15/36; F42C 15/44; F42D 5/04
See application file for complete search history.

(56) References Cited

U.S. PATENT DOCUMENTS 3,750,584 A * 8/1973 Voyentzie ..... F42C 11/008 102/207
4,119,038 A * 10/1978 Allen ..... F42C 11/06 102/207
4,372,211 A * 2/1983 Dante ..... F42C 15/40 102/207
4,585,713 A * 4/1986 Pathe ..... H01M 2/348 429/112
4,597,261 A * 7/1986 Dolan ..... F42B 39/20 60/223
4,792,903 A * 12/1988 Peck ..... B64D 25/10 244/122 A
5,006,429 A * 4/1991 Pracchia ..... H01M 6/36 429/103
5,044,154 A * 9/1991 English, Jr. ..... F02K 9/32 60/223
5,129,326 A * 7/1992 Brogan ..... F02K 9/38 102/481

(Continued)

*Primary Examiner* — Derrick R Morgan
(74) *Attorney, Agent, or Firm* — Naval Air Warfare Center Weapons Division; James M. Saunders

(57) ABSTRACT

An electronic thermally-initiated venting system (ETIVS) for rocket motors includes at least one linear-shaped charge attached to a rocket motor housing. At least one exploding foil initiator (EFI) is attached to the linear-shaped charge. At least one electronic thermally-initiated venting system circuit is electrically-connected to the EFI. The EFI is configured to auto-fire when the electronic thermally-initiated venting system circuit relays a current pulse through the EFI. The linear-shaped charge is configured to initiate when the current pulse is relayed through the EFI.

14 Claims, 2 Drawing Sheets

(56) References Cited

U.S. PATENT DOCUMENTS 5,173,570 A * 12/1992 Braun ..... F42B 3/121 102/202.7
5,206,456 A * 4/1993 Pracchia ..... H01M 6/36 102/207
5,505,134 A * 4/1996 Brooks ..... E21B 43/1185 102/202.7
5,641,935 A * 6/1997 Hunter ..... F42C 11/00 102/206
5,756,925 A * 5/1998 Frank ..... F42D 1/04 102/202.14
6,363,855 B1 * 4/2002 Kim ..... F42B 39/20 102/378
7,336,474 B2 * 2/2008 Lerche ..... B82Y 10/00 361/248
7,373,885 B2 * 5/2008 Skinner ..... F42B 39/14 102/481
7,506,586 B1 * 3/2009 Pereira ..... F42C 11/008 102/207
7,530,314 B2 * 5/2009 Skinner ..... F42B 39/20 102/378
7,743,785 B2 * 6/2010 Rohwer ..... F16K 31/002 137/79
9,459,080 B2 * 10/2016 Collins ..... F42D 5/00
9,658,026 B1 * 5/2017 Grace ..... F41B 6/006
10,197,372 B2 * 2/2019 Grace ..... F42B 3/10
2002/0020323 A1 * 2/2002 Dassis ..... F42B 39/20 102/481
2005/0178282 A1 * 8/2005 Brooks ..... E21B 43/1185 102/202.7
2007/0095239 A1 * 5/2007 Skinner ..... F42B 39/14 102/481
2007/0099335 A1 * 5/2007 Gangopadhyay ..... F42B 3/13 438/99
2007/0240600 A1 * 10/2007 Skinner ..... F42B 39/20 102/481
2010/0132577 A1 * 6/2010 Rastegar ..... F42C 9/02 102/247
2012/0017750 A1 * 1/2012 Koide ..... F42D 3/00 86/50
2013/0284042 A1 * 10/2013 Silverman ..... F42C 11/008 102/202.7
2014/0311369 A1 * 10/2014 Rastegar ..... H01H 35/142 102/216
2018/0013152 A1 * 1/2018 Rastegar ..... H01M 6/36

* cited by examiner

FOUO - Distribution Statement D

ELECTRONIC THERMALLY-INITIATED VENTING SYSTEM (ETIVS) FOR ROCKET MOTORS

CROSS-REFERENCE TO RELATED APPLICATIONS

This is a non-provisional application, claiming the benefit of parent provisional application No. 61/854,266 filed on Sep. 17, 2013, whereby the entire disclosure of which is incorporated herein by reference.

STATEMENT REGARDING FEDERALLY SPONSORED RESEARCH OR DEVELOPMENT

The invention described herein may be manufactured and used by or for the government of the United States of America for governmental purposes without the payment of any royalties thereon or therefor.

FIELD OF THE INVENTION

The invention generally relates to insensitive munitions safety. Embodiments relate to using electronic means to vent rocket motors.

Figure 1:
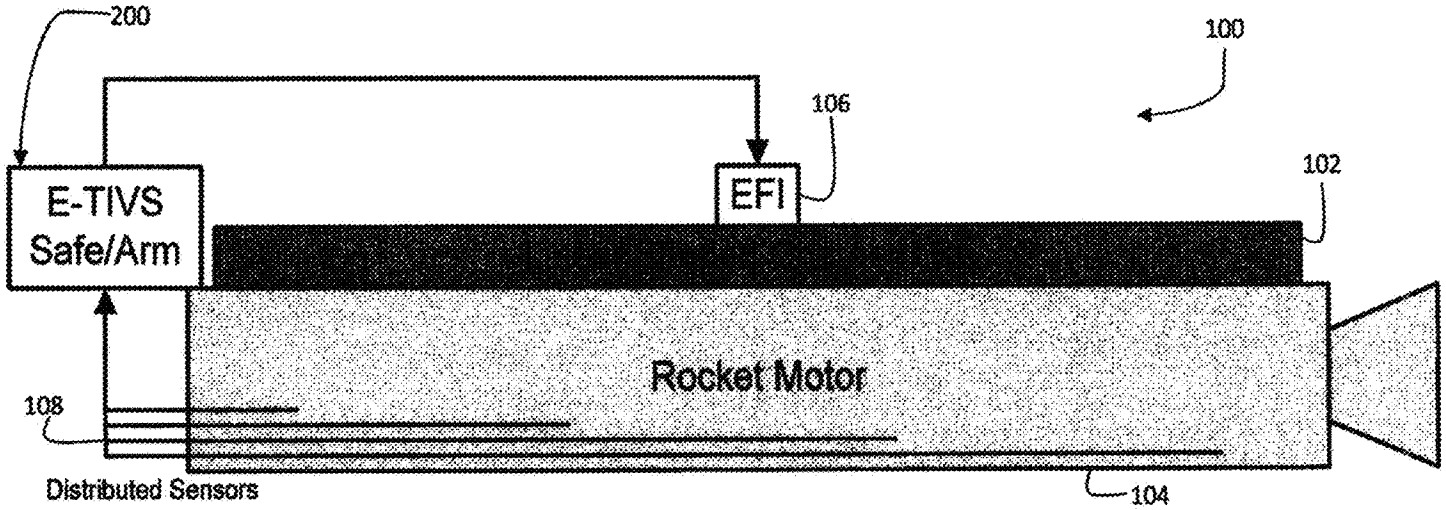
FIG. 1 illustrates an electronic thermally-initiated venting system for rocket motors, according to some embodiments of the invention.

Embodiments of the invention were the result of extensive modeling work to determine options for implementing a trigger device for a thermally-initiated venting system using standard or emerging electronic technologies. Options for implementing an electronic trigger device for a thermally initiated venting system (E-TIVS) include commercial-off-the-shelf (COTS) based electronics, a semi-custom hybrid module, and a fully custom integrated circuit fabricated using one of two available manufacturing technologies.

It is to be understood that the foregoing general description and the following detailed description are exemplary and explanatory only and are not to be viewed as being restrictive of the invention, as claimed. Further advantages of this invention will be apparent after a review of the following detailed description of the disclosed embodiments, which are illustrated schematically in the accompanying drawings and in the appended claims.

DETAILED DESCRIPTION OF EMBODIMENTS OF THE INVENTION

Embodiments of the invention relate to using electronic technology to improve insensitive munitions safety in rocket motors. Embodiments provide added safety in the form of actual temperature sensing and multiple, sequenced, arming energy locks.

Although embodiments of the invention are described in considerable detail, including references to certain versions thereof, other versions are possible. Examples of other versions include performing the orienting electrical components in alternating sequences or hosting embodiments on different platforms. Therefore, the spirit and scope of the appended claims should not be limited to the description of versions included herein.

Conventions, Parameters, and Terminology

At the outset, it is helpful to describe various conventions, parameters, and terminology associated with embodiments of the invention.

E-TIVS: Electronic Thermally Initiated Venting System Trigger Mechanism.

SCO: Slow Cookoff, consisting of conditions where the temperature of the munition is raised slowly, such as when the munition is in a bunker that is being heated by an external fire. A representative test raises the temperature of the munition at a rate of 3.3° C./hour. The slow cookoff test puts the munition in a thermal chamber and slowly increases the temperature inside the chamber. This subjects the munition to extreme temperatures with little to no temperature gradient within the munition. When the energetic materials within the munition reach a critical temperature, they begin to chemically decompose, increasing the pressure within the case of the munition. If subjected to this intense heat for enough time, the energetic materials loaded into the munition may explode.

FCO: Fast Cookoff, consisting of conditions where the temperature of the munition is raised rapidly, such as when the munition is suspended over a fuel fire. A representative test suspends the munition over an enveloping fuel fire with a temperature of at least 870° C. The fast cookoff test also imparts a large thermal stress to the munition. The temperature, however, is increased at a very high rate. To conduct the fast cookoff test, the munitions under test are suspended over a pool of burning jet fuel, and are subjected to extreme levels of heat and thermal flux. The fast heating rate associated with this test results in a large temperature gradient between the energetic materials closer to the case of the munition and those loaded nearer to the center of the munition. As in the slow cookoff test, when energetic materials reach their critical temperature, they also begin to chemically decompose. However, the large temperature gradients experienced in the fast cookoff test means that only a portion of the energetic materials loaded into the munition undergo this decomposition. Like in the slow cookoff test, the energetic materials may explode when subjected to the conditions of the fast cookoff test.

Upper Static Switch: One of the switches in the WSESRB approved Three-Switch Inline Fuze architecture is the Upper Static Switch which interrupts the flow of power to the fuze until its control signal is asserted. The Upper Static Switch is located between the power supply rail and the high voltage transformer.

Lower Static Switch: One of the switches in the WSESRB approved Three-Switch Inline Fuze architecture is the Lower Static Switch which interrupts the flow of power to the fuze until its control signal is asserted. The Lower Static Switch is located between the Dynamic Switch and the ground rail.

Dynamic Switch: One of the switches in the WSESRB approved Three-Switch Inline Fuze architecture is the Dynamic Switch which rapidly switches states as controlled by a dynamic signal driver to generate high voltage using a specialized high voltage generation transformer. The Dynamic Switch is located between the high voltage transformer and the Lower Static Switch.

WSESRB-Approved Three-Switch Inline Fuze Architecture: The preferred method for implementing the safety architecture for an inline fuze or initiation system. The Three-Switch architecture consists of an Upper Static Switch controlled by Upper Static Safety Logic, a Lower Static Switch controlled by Lower Static Safety Logic, a Dynamic Switch controlled by Dynamic Signal Generation Circuitry, and a High Voltage Transformer.

FISTRP: Fuze and Initiation System Technical Review Panel is a panel of technical experts tasked with reviewing fuze and initiation systems for system safety as directed by the WSESRB.

WSESRB: Weapons Systems Explosive Safety Review Board, the governing body for Insensitive Munitions, Energetics Safety, and Fuzing Safety for the US Navy.

Inline (Explosive Train): An initiation system where the initiator is connected to the booster, often through explosive leads, and the main energetic charge without interruption.

Out of Line (Explosive Train): An initiation system where the initiator is separated from the booster and the main energetic charge with a mechanical interruption that may be removed to arm the initiation system.

Exploding Foil Initiator: A high-voltage initiator that has been approved for inline initiation systems. The Exploding Foil Initiator is typically abbreviated as EFI.

Initiator: A device, such as an EFI, that initiates an explosive train based on an input signal of some type. This is also referred to as an electro-explosive device, or an EED.

Booster: An energetic material that initiates when exposed to the output of the initiator and is capable of initiating the Main Charge.

Main Charge: An energetic material that makes up the fill of the munition.

LSC: The TIVS Linear Shaped Charge.

Linear Shaped Charge: A device that consists of a linear hollow charge designed to cut through most of the rocket motor case, without cutting through the entire rocket motor case, in order to reduce the containment of the rocket motor propellant. The Linear Shaped Charge contains a Booster and is filled with a small amount of Main Charge material.

TIVS: A Thermally Initiated Venting System is a device connected to a Rocket Motor to improve the behavior of the rocket motor when it is exposed to high temperatures. The TIVS has a Trigger Mechanism, such as the proposed E-TIVS, an Initiator that is triggered by the Trigger Mechanism, and a Linear-Shaped Charge to score the case of the rocket motor. A Thermally Initiated Venting System (TIVS) will vent the case of the munition if exposed to cookoff environmental conditions. The TIVS utilizes a specially designed linear shaped charge to cut through most, but not all, of the case of the munition it is mounted on. This decreases the amount of pressure needed to split the case of the munition.

Under cookoff conditions: Under cookoff means that the case splits before enough pressure is built up inside the case to cause a violent reaction in the bulk of energetic materials. Without the buildup of pressure caused by the decomposing energetics, it is likely that the bulk of the energetic materials loaded into the munition will burn, or deflagrate rather than explode, after the case of the munition is split by TIVS.

Over cookoff conditions: Over cookoff means that a failure occurs in the function of the ETIVS device where there is enough pressure built up inside the case to cause a violent reaction of the energetic materials.

Apparatus/System Embodiments

In the accompanying drawings, like reference numbers indicate like elements. FIG. 1 illustrates a system according to some embodiments of the invention. Reference character 100 depicts a system of embodiments of the invention.

Embodiments of the invention generally relate to an inline venting system for rocket motors. FIG. 1 generically depicts an electronic thermally-initiated venting systems (ETIVS) for Rocket Motors (reference character 100). The system 100 includes at least one linear-shaped charge 102 attached to a rocket motor housing 104. FIG. 1 depicts reference character 104 as a "rocket motor," however the nomenclature used/shown relates to the attachment of other components, as described below.

At least one exploding foil initiator (EFI) 106 is attached to the linear shaped charge 102. At least one electronic thermally-initiated venting system (ETIVS) circuit 200 is electrically-connected to the exploding foil initiator 106. The ETIVS circuit 200 is sometimes referred to as an ETIVS trigger. The exploding foil initiator 106 is configured to auto-fire when the electronic thermally-initiated venting system circuit 200 relays a current pulse through the exploding foil initiator 106, which causes the linear-shaped charge 102 to initiate. The linear-shaped charge 102 houses a booster (not shown) and an energetic material (not shown). The exploding foil initiator 106 is connected to the booster through explosive electrical leads (not shown). A person having ordinary skill in the art will recognize that embodiments will function with various types of exploding foil initiators. For instance, an older exploding foil initiator is sometimes simply referred to as an "EFI." Newer exploding foil initiators are referred to as low energy exploding foil initiators (LEEFI" for short). Thus, when exploding foil initiators or any variation thereof are mentioned, embodiments of the invention include current and future EFI versions.

Figure 2:
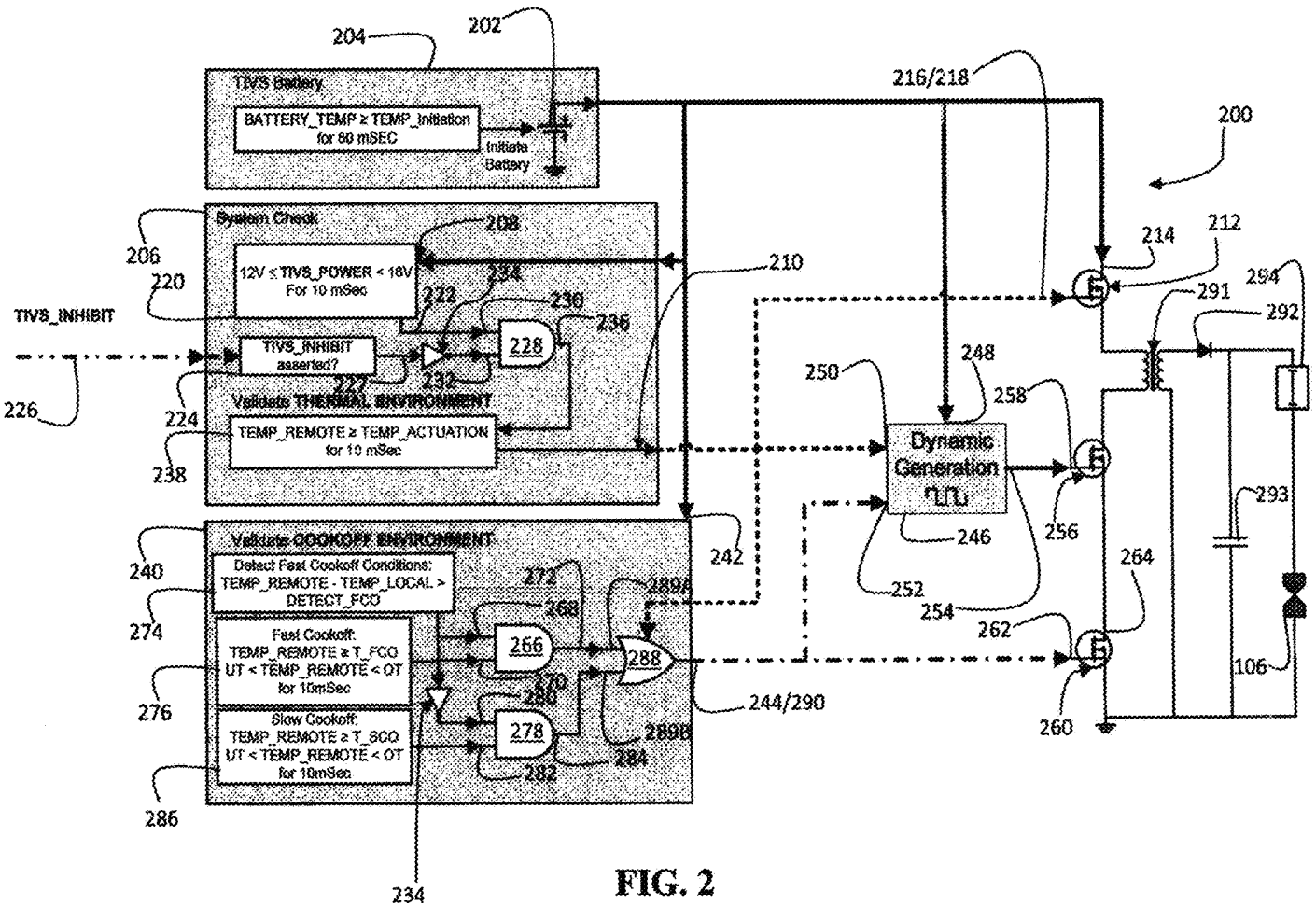
FIG. 2 is an electronic thermally-initiated venting circuit, according to some embodiments of the invention.

Turning now to FIG. 2, the ETIVS circuit 200 is shown in detail and is sometimes also referred to as an electronic thermally-initiated venting (ETIV) circuit. The ETIVS circuit 200 is housed in a thermally-insulated housing to protect components from heat. The housing can be attached to the rocket motor 104. The EFI 106 may also be located inside the ETIVS thermally-insulated housing.

As mentioned earlier, the electronic thermally-initiated venting system circuit 200 is in electrical communication with at least one exploding foil initiator (EFI) 106. The electronic thermally-initiated venting system circuit 200 includes at least one power source 202. The power source 202 is a thermal battery having an output terminal. For ease of viewing the thermal battery and output terminal are both referenced as reference character 202. The battery 202 is configured to generate power using heat of fire from a munition. The generated power is output through the battery output terminal 202.

A first integrated circuit (includes reference characters 206 and 212) is electronically-connected to the battery output terminal 202, and is described in greater detail below. A second integrated circuit (includes reference characters 240, 246, 256, & 260) and is electronically-connected to the battery output terminal 202. The first (206 & 212) and second (240, 246, 256, & 260) integrated circuits are electronically-connected to each other. The thermally-insulated housing described above, thus, is configured to house both the first and second integrated circuits. Electrical/signal communication is shown with lines and arrows in FIG. 2. Similar line types allow the viewer to follow electrical/signal paths. Paths are shown in some instances as solid lines, dashed lines, dashed/dot lines, and dashes with two dot lines for ease of viewing.

The battery is a low melting point electrolyte thermal battery configured to auto-initiate under both slow cook-off (SCO) and fast cook-off (FCO) conditions. The battery 202 has a salt electrolyte. SCO corresponds to the melting point of the salt electrolyte. FCO corresponds to the auto-initiation of an uninsulated thermal pellet. SCO conditions are in the range of about 135 to 145 degrees Celsius. FCO conditions are in the range of about 145 to 175 degrees Celsius. The temperature ranges are based upon weapon properties as tested during cookoff tests. The battery 202 is tailored to activate before cookoff so that the ETIVS circuit 200 is powered.

The munition (such as a rocket motor) has an ignition temperature (INITIATION_TEMP). The battery 202 has a battery temperature (BATTERY_TEMP). The battery 202 is configured to generate power (using heat of fire) when BATTERY_TEMP≥INITIATION_TEMP for about 50 milliseconds. This function is shown as reference character 204. The ignition temperature is a range of cookoff temperatures from the testing of the weapon so that the ETIVS circuit 200 activates at no less than 50 degrees Celsius below the respective cookoff temperatures for both SCO and FCO.

The first integrated circuit (206 & 212), includes a thermal environment system check (TESC) circuit 206 having a system check input 208 and a system check output 210. The system check input 208 is electrically-connected to said battery output terminal 202 and is configured to receive the generated power from said battery output terminal. An upper static switch 212 having an upper static switch power input 214, an upper static switch signal input 216, and an upper static switch signal output 218. The upper static switch signal input 216 and upper static switch signal output 218 are shown in the same location on FIG. 2 for ease of viewing.

The TESC circuit 206 includes a thermally-initiated power check (reference character 220), (TIVS_Power), to determine output voltage, (TIVS_Power), from the battery 202, and whether 12 V≤TIVS_Power<16V for at least 10 mSec. The thermally-initiated power check 220 has a thermally-initiated power check output 222. A TIVS_INHIBIT assertion block (reference character 224) is configured to receive a signal from an ignition safety device (shown as reference character 226) on the munition, said TIVS_INHIBIT having an TIVS_INHIBIT output 227.

A TESC two input AND gate 228 having a first AND gate input 230, a second AND gate input 232, and an AND gate output 236 is included. Inverters (reference character 234) are used to allow regular AND gates to be used throughout embodiments of the invention. The first AND gate input 230 is electrically-connected to the thermally-initiated power check output 222 and the second AND gate input 232 is electrically-connected to the TIVS_INHIBIT output 227.

A thermal environment validation circuit 238 is included. When 12 V≤TIVS_Power<16V for at least 10 mSec and the signal from the TIVS_INHIBIT is not asserted, then the thermal environment validation circuit validates whether the munition temperature, TEMP_REMOTE, is greater than or or equal to an actuation temperature threshold, TEMP_ACTUATION (TEMP_REMOTE≥TEMP_ACTUATION) for at least 10 mSec. When TEMP_REMOTE≥TEMP_ACTUATION for at least 10 mSec, the upper static switch 212 is asserted through the upper static switch signal input 216.

The second integrated circuit (240, 246, 256, & 260) includes a cookoff environment validation (CEV) circuit 240 having a CEV power input 242 and a cookoff environment validation (CEV) signal output 244. The CEV power input 242 is electrically-connected to the battery output terminal 202. A dynamic signal generator (DSG) circuit 246 has a DSG power input 248, a first DSG signal input 250, a second DSG signal input 252, and DSG output 254. The DSG power input 248 is electrically-connected to the battery output terminal 202. The said first DSG signal input 250 is electrically-connected to the TESC system check output 210. The second DSG signal input 252 is electrically-connected to the CEV signal output 244. The dynamic signal generator circuit 246 is configured to generate a dynamic signal.

A dynamic switch 256 has a dynamic switch input 258 in electrical communication with the DSG output 254. The dynamic switch input 258 is configured to receive the dynamic signal from the DSG output 254. A lower static switch 260 has a first lower static switch input 262 electrically connected to the CEV signal output 244 and a second lower static switch input 264 electrically connected to the dynamic switch 256. The CEV circuit 240 also includes a temperature gradient positioned between a local sensor mounted within the ETIVS housing (or alternatively mounted on the EFI 106) and at least one remote sensor (shown as "distributed sensors in FIG. 1) 108 mounted along the rocket motor 104. The temperature gradient determines whether the CEV circuit 240 operates in fast cookoff or slow cookoff mode.

The CEV circuit 240 has a first CEV two input AND gate 266 having a first AND gate input 268, a second AND gate input 270, and a first CEV AND gate output 272. The first CEV two input AND gate 266 is a fast cook off AND gate. The fast cook off AND gate 266 is asserted when fast cook off conditions are detected and validated. Fast cook off conditions are detected, as shown in block 274, when TEMP_REMOTE−TEMP_LOCAL>DETECT_FCO, where TEMP_REMOTE is the temperature of the remote sensors 108, and TEMP_LOCAL is the temperature of the local sensors, and DETECT_FCO is the fast cook off temperature.

The fast cook off conditions are validated, as shown in block 276, when TEMP_REMOTE≥T_FCO_UT<TEMP_REMOTE<T_FCO_OT for 10 milliseconds, where T_FCO_UT and T_FCO_OT are the under temperature and over temperature, respectively, of the remote sensors 108. For both fast and slow cook off, "UT" and "Or" are used to determine that the sensors are functioning properly.

A second CEV two input AND gate 278 having a first AND gate input 280, a second AND gate input 282, and a second CEV AND gate output 284. The second CEV two input AND gate 278 is a slow cook off AND gate. The slow cook off AND gate 278 is asserted when fast cook off conditions are not detected (from block 274) and slow cook off conditions are validated. Slow cook off conditions are validated, as depicted in block 286, when TEMP_REMOTE≥T_SCO_UT<TEMP_REMOTE<T_SCO_OT for 10 milliseconds, where T_SCO_UT and T_SCO_OT are the under temperature and over temperature, respectively, of the remote sensors 108.

A two input OR gate 288 has a first OR gate input 289A, a second OR gate input 289B, and an OR gate output 290. The first OR gate input 289A is electrically-connected to the first CEV AND gate output 272. The second OR gate input 289B is electrically-connected to the second CEV AND gate output 284. The OR gate output 290 is the CEV signal output 244 mentioned above, but is depicted with a different number for ease of reading and viewing. The OR gate output 290 is in electrical signal communication with the DSG circuit 246 and the lower static switch 260.

A flyback transformer (sometimes referred to as a high-voltage transformer or flyback converter/controller) 291 and a high voltage diode 292 are connected in series. The flyback transformer 291 is electrically-connected to the upper static switch 212 and the DSG circuit 246. A firing capacitor 293 is electrically-connected to the flyback transformer 291 and high-voltage diode 292. The firing capacitor 293 has a capacitance range of about 0.1 μF to about 0.2 μF and a voltage range of about 1000 V to about 4000 V.

The firing capacitor 293 is connected in parallel to a gas discharge tube 294 and the exploding foil initiator 106. The exploding foil initiator 106, the firing capacitor 293 is connected in parallel with the upper static switch 212 and the lower static switch 260. The firing capacitor is charged when the dynamic signal from the DSG circuit 246 is fed to the dynamic switch 256. The gas discharge tube 294 is configured to discharge when the firing capacitor 291 reaches firing voltage. The gas discharge tube 294 is configured to break over. The firing capacitor 291 is configured to discharge a current pulse through the exploding foil initiator 106. The current pulse then initiates the linear-shaped charge 102.

A pulse discharge circuit may be electrically connected to the exploding foil initiator 106. The pulse discharge circuit detects the current pulse through the exploding foil initiator 106. The current pulse may be detected using a high-speed transimpedance amplifier latched through a D flip-flop. When a latched signal is asserted, the lower static switch 260 is disabled.

In embodiments, battery voltage is checked using a window comparator for proper operation. The TIVS_INHIBIT signal 226 is controlled by a device external to the ETIVS circuit 200. An Ignition Safety Device (ISD) will assert TIVS_INHIBIT when the ISD initiates the Rocket Motor. Other systems may implement this functionality in a different manner. If TIVS_INHIBIT is asserted, the TIVS will not operate.

Sensors implement a thermal cutoff switch, a bimetallic switch, or a fusible link. The bimetallic switch is resettable nature and has reasonably accurate switching points. Multiple sensors (multiple bimetallic switches, wired in parallel) can be distributed along the weapon (along the rocket motor case), if so desired, without detracting from the merits or generalities of embodiments of the invention.

In embodiments, the sensors actuate at a specified temperature, and when the sensor reaches this temperature it will actuate. Within the E-TIVS, the sensor actuation is qualified for 10 mSec to filter out spurious actions. When the sensor input asserted, an upper static switch 212 will be enabled/asserted. The actuation temperature of the thermal environment sensor can be selected for a given energetic material and qualification time of the thermal environment can be programmed through use of passive components, allowing for flexibility in configuring the E-TIVS trigger.

In embodiments, the E-TIVS housing is thermally insulated and provided with a sufficiently large thermal mass, to allow the E-TIVS hardware to survive the fast cookoff environment. This insulation and thermal mass is used to detect thermal gradients, as the local sensor will take much longer to heat up than the remote sensor.

When the remote temperature has exceeded the slow cookoff temperature threshold, but does not exceed the programmed error threshold used to detect a faulty sensor, for a programmed period of time, the lower static switch 260 is enabled/asserted. If the E-TIVS has detected fast cookoff conditions, where the local temperature and the remote temperature differ by more than a programmed margin, the programmed fast cookoff thresholds are used to determine when the lower static switch 260 is enabled. When the remote temperature has exceeded the fast cookoff temperature threshold, but does not exceed the programmed error threshold used to detect a faulty sensor, for a programmed period of time, the lower static switch is enabled. The slow cookoff time and temperature settings, fast cookoff time and temperature settings, and the cookoff temperature margin can be individually programmed through use of passive components, allowing for flexibility in configuring the E-TIVS trigger.

In embodiments, when both static switches (212 & 260) have been enabled, the dynamic signal generator circuit 246 (sometimes referred to as dynamic drive circuitry or simply dynamic driver) is engaged. The dynamic signal generator circuit 246 is prevented from operating before this point using two separate drive controls. The upper static switch 212 is used to control power supplied to the dynamic signal generator circuit 246. When upper static switch 212 is asserted, power is supplied to the device. The lower static switch 262 is used to enable the dynamic signal generator circuit 246 through an accessible run control input on the dynamic signal generator circuit 246. Embodiments of the invention also include the option of increasing the number of controls on the dynamic driver circuitry, such as controlling an oscillator input to the dynamic driver, should additional controls be warranted.

Embodiments of the invention are configured using components based on application-specific conditions such as, for example, temperature. Some of the many possible types of components that can be used for configuring embodiments of the invention are discussed below.

Commercial-Off-the-Shelf (COTS) Components

Commercially available electronics have traditionally had a maximum temperature rating of +125 C. Components are selected based on expected operating temperature. For components that are not rated to operate at the high temperature, temperature performance testing, and long-term burn-in testing methods can be used to screen low temperature parts for performance at high temperatures.

Semi-Custom Hybrid Module

A hybrid module, also known as a hybrid circuit, contains much of what is in a modern integrated circuit, including diodes, resistors, capacitors, and transistors. Unlike a modern integrated circuit, where all of these components are integrated onto a single semiconductor die, a hybrid circuit contains multiple parts within a single sealed package, including discrete components and integrated circuits.

A similar method can be used to build the E-TIVS trigger device. Most commercially available high-temperature components are sold as bare silicon dies, without large and heavy packaging. Custom integrated circuits can also be delivered in this manner. A number of these bare dies can be packaged in a single, hermetically sealed ceramic module that will implement all the necessary interconnects between the components.

Custom Integrated Circuit, Standard Process

Custom integrated circuits may be used for component circuitry. High temperature electronics rely on specific fabrication processes to work. As electronics get hot, the leakage current increases greatly. For integrated circuits fabricated using a bulk silicon process, this leakage will overwhelm the desired signal in the device at a relatively low temperature, in the range of +125 C to +150 C. Integrated circuits fabricated using a silicon-on-insulator (SOI) process have greatly reduced leakage, as the active devices have no connection to one another apart from the etched metal traces on the IC. These SOI processes have been tested and qualified to operate at temperatures up to +220 C. A full-custom integrated circuit can be developed to implement the E-TIVS trigger device. Using one of the available high temperature processes, an integrated circuit can be fabricated that will work across the operating temperature range of the E-TIVS device.

Custom Integrated Circuit, Exotic Process

Wide bandgap semiconductors, such as Silicon Carbide (SiC) or Gallium Nitride (GaN), are also included within embodiments of the invention. Circuits built using these wide bandgap semiconductor technologies have been demonstrated in the laboratory and even have been fabricated at small scales. The performance of these processes is undeniable, with mixed analog and digital circuit operation at temperatures up to and above +400 C being reported. The operational voltages of devices fabricated using these processes is also impressive, with operating voltages reported to be in the range of 15V to 20V compared to the +3.3V to +5V of standard silicon processes.

Most digital circuits, such as logic gates and flip-flops, and some analog circuits, such as operational amplifiers and comparators, are easily implementable in custom integrated circuits. In some cases, the integrated circuit fabrication house can provide these circuit elements as a library of standard cells when providing documentation on the fabrication process.

Table I is a listing of commercially available extreme temperature components. The operating temperatures are shown in degrees Celsius. Extreme temperature is generally considered in the art to be temperatures in excess of 210 degrees Celsius. The last column indicates whether or not testing (screening) is needed to determine whether the component is operational at 210 degrees Celsius.

TABLE I

Commercially Available Extreme Temperature Components.

| Component | Manufacturer | Wire Bondable or Die Available | Operating Temperature | Needs Screening |
|---|---|---|---|---|
| Capacitor, Ceramic Class 1 | AVX Corporation | No | −55, +200 | No |
| Capacitor, Ceramic Class 1 | Kemet | No | −55, +200 | No |
| Capacitor, Ceramic Class 2 | AVX Corporation | No | −55, +200 | No |
| Capacitor, Ceramic Class 2 | Kemet | No | −55, +200 | No |
| Capacitor, Wet Slug Tantalum | Vishay Sprague | No | −55, +200 | No |
| Capacitor, Wet Slug Tantalum | AVX Corporation | No | −55, +200 | No |
| Capacitor, Tantalum | Kemet | No | −55, +175 | No |
| Capacitor, Tantalum | AVX Corporation | No | −55, +175 | No |
| Resistor, SMD | Vishay Precision | Yes | −55, +175 | No |
| Resistor, SMD | Mini-Systems Inc. | Yes | −65, +150 | Yes |
| Resistor, Through Hole | Caddock | No | −55, +175 | No |
| Magnetic Core | Micrometals | No | +200 | No |
| Diode, MIL-PRF-19500 | Microsemi | No | −60, +175 | No |
| Diode, Ceramic, High Voltage | Voltage Multipliers Inc | No | −65, +175 | No |
| MOSFET, P-Type Signal | Vishay | No | −55, +175 | No |
| MOSFET, N-Type Signal | Vishay | No | −55, +175 | No |
| MOSFET, P-Type Power | Vishay | No | −55, +175 | No |
| MOSFET, P-Type Power | Infineon | No | −55, +175 | No |
| MOSFET, N-Type Power | Vishay | No | −55, +175 | No |
| MOSFET, N-Type Power | Infineon | No | −55, +175 | No |
| MOSFET, N-Type Power | International Rectifiers | No | −40, +175 | No |
| MOSFET, N-Type Power | Honeywell | No | −55, +225 | No |
| Operational Amplifier | Texas Instruments | Yes | −55, +210 | No |
| Operational Amplifier | Honeywell | Yes | −55, +225 | No |
| Instrumentation Amplifier | Texas Instruments | Yes | −55, +210 | No |
| Instrumentation Amplifier | Analog Devices | No | −40, +210 | No |
| DC/DC Flyback Controller | Texas Instruments | Yes | −55, +210 | No |
| Linear Regulator | Texas Instruments | Yes | −55, +210 | No |
| Linear Regulator | Honeywell | No | −55, +225 | No |
| Voltage Reference | Texas Instruments | Yes | −55, +210 | No |
| Logic Gates, 4000 Series | Texas Instruments | No | −55, +125 | Yes |
| Logic Gates, 54 Series CMOS | Texas Instruments | No | −55, +125 | Yes |

A full-custom integrated circuit can be developed on one of these emerging exotic processes to implement the E-TIVS trigger device. Using one of the emerging exotic processes, an integrated circuit can be fabricated that will work outside the expected operating temperature range of the E-TIVS device. The custom IC can then be packaged in a hermetically sealed ceramic module that will also exceed the expected operating temperature range of the E-TIVS device.

Summary of Potential ETIVS Components

Several viable component options may be used to configure an electronic TIVS trigger device using an in-line explosive train configuration for the output to the TIVS linear shaped charge. Embodiments of the invention may incorporate any single, combination, or other components not listed, depending on application-specific conditions such as, for example, on how the system is intended to be fielded.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

What is claimed is:

1. An inline venting system for rocket motors, comprising:

at least one linear-shaped charge attached to a rocket motor housing;

at least one exploding foil initiator (EFI) attached to said at least one linear shaped charge; and at least one electronic thermally-initiated venting system circuit electrically-connected to said at least one exploding foil initiator, wherein said at least one exploding foil initiator is configured to auto-fire when said at least one electronic thermally-initiated venting system circuit relays a current pulse through said exploding foil initiator, wherein said at least one linear-shaped is configured to initiate when said current pulse is related through said at least one exploding foil initiator; and wherein said at least one electronic thermally-initiated venting circuit is housed in a thermally-insulated housing, said at least one thermally-initiated venting circuit, comprising:

at least one power source, wherein said at least one power source is a thermal battery having an output terminal, wherein said battery is configured to generate power using heat of fire from a munition, wherein said generated power is output through said battery output terminal;

a first integrated circuit electronically-connected to said battery output terminal; and a second integrated circuit electronically-connected to said battery output terminal, wherein said first integrated circuit and said second integrated circuit are electronically-connected to each other; and a thermally-insulated housing configured to house said first integrated circuit and said second integrated circuit; and said second integrated circuit, comprising:

a cookoff environment validation (CEV) circuit having a CEV power input and a cookoff environment validation (CEV) signal output, wherein said CEV power input is electrically-connected to said battery output terminal;

a dynamic signal generator (DSG) circuit having an DSG power input, a first DSG signal input, a second DSG signal input switch, and an DSG output, wherein said DSG power input is electrically-connected to said battery output terminal, said first DSG signal input is electrically-connected to said TESC system check output, said second DSG signal input is electrically-connected to said CEV signal output, wherein said dynamic signal generator circuit is configured to generate a dynamic signal;

a dynamic switch having a dynamic switch input in electrical communication with said DSG output, said dynamic switch input is configured to receive said dynamic signal from said DSG output;

a lower static switch having a first lower static switch input electrically connected to said CEV signal output, a second lower static switch input electrically connected to said dynamic switch;

wherein said CEV circuit further comprises:

a temperature gradient positioned between a local sensor mounted within said housing and at least one remote sensor mounted along said rocket motor, wherein said temperature gradient determines whether said CEV circuit operates in fast cookoff or slow cookoff mode.

2. The venting system according to claim 1, wherein said at least one linear shaped charge houses a booster and an energetic material.

3. The venting system according to claim 2, wherein said at least one exploding foil initiator is connected to said booster through explosive electrical leads.

4. The venting system according to claim 1 wherein said battery is a low melting point electrolyte thermal battery configured to auto-initiate under both slow cook-off (SCO) and fast cook-off conditions (FCO).

5. The venting system according to claim 1, wherein said munition has an ignition temperature (INITIATION_TEMP), wherein said battery has a battery temperature (BATTERY_TEMP), wherein said battery is configured to generate power when BATTERY_TEMP≥INITIATION_TEMP for about 50 milliseconds.

6. The venting system according to claim 5, wherein said first integrated circuit, comprising:

a thermal environment system check (TESC) circuit having a system check input and a system check output, said system check input is electrically-connected to said battery output terminal and is configured to receive said generated power from said battery output terminal;

an upper static switch having an upper static switch power input, an upper static switch signal input, and an upper static switch signal output, wherein said upper static switch power input is electrically-connected to said battery output terminal;

wherein said TESC circuit further comprises:

a thermally-initiated power check, (TIVS_Power), to determine output voltage, (TIVS_Power), from said battery, and whether 12 V<TIVS_Power<16V for at least 10 mSec, wherein said thermally-initiated power check has a thermally-initiated power check output;

a TIVS_INHIBIT assertion block configured to receive a signal from an ignition safety device on said munition, said TIVS_INHIBIT having an TIVS_INHIBIT output;

a TESC two input AND gate having a first AND gate input, a second AND gate input, and an AND gate output, wherein said first AND gate input is electrically-connected to said thermally-initiated power check output, wherein said second AND gate input is electrically-connected to said TIVS_INHIBIT output;

a thermal environment validation circuit, wherein when 12 V≤TIVS_Power<16V for at least 10 mSec and said signal from said TIVS_INHIBIT is not asserted, said thermal environment validation circuit validates whether munition temperature, TEMP_REMOTE, is greater than or or equal to an actuation temperature threshold, TEMP_ACTUATION, (TEMP_REMOTE≥TEMP_ACTUATION) for at least 10 mSec; and when TEMP_REMOTE≥TEMP_ACTUATION) for at least 10 mSec, said upper static switch is asserted through said upper static switch signal input.

7. The venting system according to claim 1, said CEV circuit, comprising:

a first CEV two input AND gate having a first AND gate input, a second AND gate input, and an first CEV AND gate output, wherein said first CEV two input AND gate is a fast cook off AND gate;

wherein said fast cook off AND gate is asserted when fast cook off conditions are detected and validated;

wherein said fast cook off conditions are detected when TEMP_REMOTE−TEMP_LOCAL >DETECT_FCO, wherein said TEMP_REMOTE is the temperature of said remote sensors, wherein said TEMP_LOCAL is the temperature of said local sensors, wherein said DETECT_FCO is the fast cook off temperature;

wherein said fast cook off conditions are validated when TEMP_REMOTE≥T_FCO_UT<TEMP_REMOTE <T_FCO_OT for 10 milliseconds, wherein T_FCO_UT and T_FCO_OT are the under temperature and over temperature, respectively, of said remote sensors;

a second CEV two input AND gate having a first AND gate input, a second AND gate input, and a second CEV AND gate output, wherein said second CEV two input AND gate is a slow cook off AND gate;

wherein said slow cook off AND gate is asserted when fast cook off conditions are not detected and slow cook off conditions are validated, wherein said slow cook off conditions are validated when TEMP_REMOTE≥T_SCO_UT<TEMP_REMOTE <T_SCO_OT for 10 milliseconds, wherein T_SCO_UT and T_SCO_OT are the under temperature and over temperature, respectively, of said remote sensors; and a two input OR gate having a first OR gate input, a second OR gate input, and an OR gate output, wherein said first OR gate input is electrically-connected to said first CEV AND gate output, wherein said second OR gate input is electrically-connected to said second CEV AND gate output, wherein said OR gate output is in electrical signal communication with said DSG circuit and said lower static switch.

8. The venting system according to claim 7, further comprising:

a flyback transformer and high voltage diode connected in series, said flyback transformer electrically-connected to said upper static switch and said DSG circuit;

a firing capacitor electrically-connected to said flyback transformer and high-voltage diode, said firing capacitor having capacitance range of about 0.1 μF to about 0.2 μF and a voltage range of about 1000 V to about 4000 V;

wherein said firing capacitor is connected in parallel to a gas discharge tube and exploding foil initiator, said exploding foil, said firing capacitor connected in parallel with said upper static switch and said lower static switch, wherein said firing capacitor is charged when said dynamic signal from said DSG circuit is fed to said dynamic switch;

wherein said gas discharge tube is configured to discharge when said firing capacitor reaches firing voltage, wherein said gas discharge tube is configured to break over, wherein said firing capacitor is configured to discharge a current pulse through said exploding foil initiator, wherein said current pulse is configured to initiate said linear shaped charge.

9. An electronic thermally-initiated venting system circuit in electrical communication with at least one exploding foil initiator (EFI), said electronic thermally-initiated venting system circuit, comprising:

at least one power source, wherein said at least one power source is a thermal battery having an output terminal, wherein said battery is configured to generate power using heat of fire from a munition, wherein said generated power is output through said battery output terminal;

a first integrated circuit electronically-connected to said battery output terminal; and a second integrated circuit electronically-connected to said battery output terminal, wherein said first integrated circuit and said second integrated circuit are electronically-connected to each other; and the thermally-insulated housing configured to house said first integrated circuit and said second integrated circuit; and the circuit further comprising:

a flyback transformer and high voltage diode connected in series, said flyback transformer electrically-connected to an upper static switch and said DSG circuit;

a firing capacitor electrically-connected to said flyback transformer and high-voltage diode, said firing capacitor having capacitance range of about 0.1 μF to about 0.2 μF and a voltage range of about 1000 V to about 4000 V;

wherein said firing capacitor is connected in parallel to a gas discharge tube and exploding foil initiator, said exploding foil, said firing capacitor connected in parallel with said upper static switch and a lower static switch, wherein said firing capacitor is charged when said dynamic signal from said DSG circuit is fed to said dynamic switch;

wherein said gas discharge tube is configured to discharge when said firing capacitor reaches firing voltage, wherein said gas discharge tube is configured to break over, wherein said firing capacitor is configured to discharge a current pulse through said exploding foil initiator, wherein said current pulse is configured to initiate said linear shaped charge.

10. The circuit according to claim 9, wherein said battery is a low melting point electrolyte thermal battery configured to auto-initiate under both slow cook-off (SCO) and fast cook-off conditions (FCO).

11. The circuit according to claim 9, wherein said munition has an ignition temperature (INITIATION_TEMP), wherein said battery has a battery temperature (BATTERY_TEMP), wherein said battery is configured to generate power when BATTERY_TEMP≥INITIATION_TEMP for about 50 milliseconds.

12. The circuit according to claim 11, said first integrated circuit, comprising:

a thermal environment system check (TESC) circuit having a system check input and a system check output, said system check input is electrically-connected to said battery output terminal and is configured to receive said generated power from said battery output terminal;

said upper static switch having an upper static switch power input, an upper static switch signal input, and an upper static switch signal output, wherein said upper static switch power input is electrically-connected to said battery output terminal;

wherein said TESC circuit further comprises: a thermally-initiated power check, (TIVS_Power), to determine output voltage, (TIVS_Power), from said battery, and whether 12 V≤TIVS_Power<16V for at least 10 mSec, wherein said thermally-initiated power check has a thermally-initiated power check output;

a TIVS_INHIBIT assertion block configured to receive a signal from an ignition safety device on said munition, said TIVS_INHIBIT having an TIVS_INHIBIT output;

a TESC two input AND gate having a first AND gate input, a second AND gate input, and an AND gate output, wherein said first AND gate input is electrically-connected to said thermally-initiated power check output, wherein said second AND gate input is electrically-connected to said TIVSJINHIBIT output;

a thermal environment validation circuit, wherein when 12 V≤TIVS_Power<16V for at least 10 mSec and said signal from said TIVS_INHIBIT is not asserted, said thermal environment validation circuit validates whether munition temperature, TEMP_REMOTE, is greater than or equal to an actuation temperature threshold, TEMP_ACTUATION, (TEMP_REMOTE≥TEMP_ACTUATION for at least 10 mSec; and when TEMP_REMOTE≥TEMP_ACTUATION) for at least 10 mSec, said upper static switch is asserted through said upper static switch signal input.

13. The circuit according to claim 12, said second integrated circuit, comprising:

a cookoff environment validation (CEV) circuit having a CEV power input and a cookoff environment validation (CEV) signal output, wherein said CEV power input is electrically-connected to said battery output terminal;

said dynamic signal generator (DSG) circuit having a DSG power input, a first DSG signal input, a second DSG signal input switch, a DSG output, wherein said DSG power input is electrically-connected to said battery output terminal, said first DSG signal input is electrically-connected to said TESC system check output, said second DSG signal input is electrically-connected to said CEV signal output, wherein said dynamic signal generator circuit is configured to generate a dynamic signal;

a dynamic switch having a dynamic switch input in electrical communication with said DSG output, said dynamic switch input is configured to receive said dynamic signal from said DSG output;

said lower static switch having a first lower static switch input electrically connected to said CEV signal output, a second lower static switch input electrically connected to said dynamic switch;

wherein said CEV circuit further comprises:

a temperature gradient positioned between a local sensor mounted within said housing and at least one remote sensor mounted along said rocket motor, wherein said temperature gradient determines whether said CEV circuit operates in fast cookoff or slow cookoff mode.

14. The circuit according to claim 13, said CEV circuit, comprising:

a first CEV two input AND gate having a first AND gate input, a second AND gate input, and an first CEV AND gate output, wherein said first CEV two input AND gate is a fast cook off AND gate;

wherein said fast cook off AND gate is asserted when fast cook off conditions are detected and validated;

wherein said fast cook off conditions are detected when TEMP_REMOTE−TEMP_LOCAL >DETECT_FCO, wherein said TEMP_REMOTE is the temperature of said remote sensors, wherein said TEMP_LOCAL is the temperature of said local sensors, wherein said DETECT_FCO is the fast cook off temperature;

wherein said fast cook off conditions are validated when TEMP_REMOTE≥T_FCO_UT<TEMP_REMOTE <T_FCO_OT for 10 milliseconds, wherein T_FCO_UT and T_FCO_OT are the under temperature and over temperature, respectively, of said remote sensors;

a second CEV two input AND gate having a first AND gate input, a second AND gate input, and a second CEV AND gate output, wherein said second CEV two input AND gate is a slow cook off AND gate;

wherein said slow cook off AND gate is asserted when fast cook off conditions are not detected and slow cook off conditions are validated, wherein said slow cook off conditions are validated when TEMP_REMOTE≥T_SCO_UT<TEMP_REMOTE<T_SCO_OT for 10 milliseconds, wherein T_SCO_UT and T_SCO_OT are the under temperature and over temperature, respectively, of said remote sensors; and a two input OR gate having a first OR gate input, a second OR gate input, and an OR gate output, wherein said first OR gate input is electrically-connected to said first CEV AND gate output, wherein said second OR gate input is electrically-connected to said second CEV AND gate output, wherein said OR gate output is in electrical signal communication with said DSG circuit and said lower static switch.

* * * * *